United States Patent [19]

Clerk

[11] 3,977,437

[45] Aug. 31, 1976

[54] CONTROL SYSTEMS FOR HYDRAULIC PUMPS AND MOTORS

[76] Inventor: Robert Cecil Clerk, Edison House, Fullerton Road Queensway Industrial Estate, Glenrothes, Fife, Scotland

[22] Filed: June 24, 1974

[21] Appl. No.: 482,259

[30] Foreign Application Priority Data

June 22, 1973 United Kingdom ..... 29689/73

[52] U.S. Cl. ..... 137/625.66; 417/218; 91/506

[51] Int. Cl.[2] ..... E03B 5/00; F04B 49/00

[58] Field of Search ..... 417/218–222; 91/504–506, 368; 137/625.66; 60/447, 448, 450

[56] References Cited

UNITED STATES PATENTS

| | | | |
|---|---|---|---|
| 2,379,546 | 7/1945 | Snader et al. | 60/450 |
| 2,732,808 | 1/1956 | Stoyke | 417/222 |
| 3,009,422 | 11/1961 | Davis et al. | 417/222 |
| 3,017,750 | 1/1962 | Kempson | 417/218 |
| 3,384,027 | 5/1968 | Jennings et al. | 123/179 F |
| 3,667,867 | 6/1972 | Boydell et al. | 91/506 |
| 3,738,779 | 6/1973 | Hein et al. | 417/213 |
| 3,806,280 | 4/1974 | Bobier | 417/222 |
| 3,834,280 | 9/1974 | Jones | 91/505 |
| 3,834,836 | 9/1974 | Hein et al. | 417/222 |

FOREIGN PATENTS OR APPLICATIONS

| | | | |
|---|---|---|---|
| 1,150,852 | 6/1963 | Germany | 91/506 |

*Primary Examiner*—William L. Freeh
*Assistant Examiner*—G. P. La Pointe
*Attorney, Agent, or Firm*—Lerner, David, Littenberg & Samuel

[57] ABSTRACT

Control valve assemblies are taught which can be inserted into or associated with a basic primary unit for causing such basic primary unit to perform with optimum performance characteristics as a pump or motor, and a master or slave unit, etc. The function that the basic primary unit performs depends upon the control valve assembly selected. In the preferred embodiment of the control valve assembly, there is provided a central coaxial probe which passes through a bore in the spool valve body and is reponsive to a signal which is in addition to the other signals being sensed by the control valve assembly.

2 Claims, 6 Drawing Figures

CONTROL SYSTEMS FOR HYDRAULIC PUMPS AND MOTORS

This invention relates to improvements to control systems for hydraulic pumps and motors, and in particular to an interacting complex of hydraulic pump or pumps and motor or motors, and/or actuators some or all of which may be variable as to their volumetric displacements, their rotational speeds and their operating pressures, some or all of which require to be modulated individually or in unison to meet a plethora of operational requirements in response to simple operator instructions or demands.

It is well known for the control and modulation of such hydraulic controlling circuits to be effected by large numbers of differing types of valves (directional, change-over, sequence, servo, etc.) circuited in series, parallel, bypass and pilot configurations and having manual, solenoid, hydraulic, pneumatic or mechanical actuations controlled from information processed by mental, mechanical, electrical, electronic or fluidic means.

The object of the present invention is to provide a simple modular cartridge assembly or control valve assembly, for insertion into or association with a variable pump/motor, which accepts the operator demand and other information via a collator/transducer which transforms all the input information, some of which may be in pneumatic or electric form, to a basic hydraulic "language". This modular cartridge assembly predicts and prescribes the fundamentals and character of the pump/motor prime unit of which it has become a part, accepts the processed operator demand signals as well as other relevant signals whether self-induced or extraneous, solves the conflict or combination of these signals, and provides output signals to actuate control of its parent unit and/or related units: by so doing it controls all the operational functions which it is required to do in response to simple operator control demands.

A further object of the present invention is to formulate standardised input locations, whether used or not, so that any pre-programmed modular computing valve cartridge can be inserted into or associated with a basic primary unit of appropriate size thereby transforming such basic unit into a pump or motor optimised to a particular application, one unit of any complex of primary units usually being programmed as the master and the others as subsidiary or slave units.

To this end what I propose is a pump/motor control element comprising a modular cartridge assembly one end of which is formed as a multi input/output spool valve body, the input and output spool ports being each associated with an annular collector groove external of the body by radially inwards drillings the said collector grooves being axially separated each from its neighbour by sealing means and being axially in dimensional register with holes formed in the casing of the pump/motor wherein a bore is provided for insertion of the cartridge such holes communicating with specific input signals and outputs, auxiliary pressure mains and drains, each allotted a precise axial location in the insertion bore. It is convenient for a further signal to be engaged and connected by a central coaxial probe at the limit of insertion.

The other end of the modular cartridge is smaller in diameter so as to be clear of the insertion bore and/or its projecting end-closure, and serves as a hydromechanical analogue transducer/computer providing both active and passive axial control of the valve spool in association with a co-axial mechanical feedback input from the pump/motor displacement actuator.

The internal detail both of the cartridge valve and of the hydro-mechanical spool activator vary according to application, from the simple slave control of a primary motor where the spool abnormality is limited to internally communicating passageways and the activator has no hydraulic content except for damping, to the complex telescopic multi-path spool and the square function pressure differential integrating activator appropriate to a kinetic accumulator primary pump (for a vehicle) which in addition to controlling the simpler operational functions such as accumulator charging rate and storage limitation, hydraulic output and power limitation, reverse driving, free towing, two-starting or accumulator starting the vehicle engine, engine compressing braking and regenerative hydraulic braking, also solves the energy summation of vehicle and accumulator to a sliding constant and controls the accumulator energy input accordingly, whether the input be from the vehicle engine which will be controlled appropriately, or from regenerative braking which can be partially or wholly transferred to the vehicle wheel-brakes if the energy summation constant is exceeded whilst braking or if the braking requirement is greater than the regenerative capability.

In an interacting complex of primary units, each having a modular cartridge insert complementarily programmed, the necessity for multiplexed pilot control circuits is much reduced, even nullified in certain applications where the power circuit carries enough information stimuli for the simpler complementarily programmed control cartridge(s) to respond fully to.

The information collator/transducer may also be conveniently formed as modular cartridge assemblies inserted into a reservoir or other casing having the circuit interconnections imprinted in subplate joint facings, and having push-on connections for plastic tubing bringing the operator's displacer demand signals which are very low pressure pneumatic or hydraulic signals. The processed signals, at a maximum pressure optimised between 400 psi and 600 psi according to application, are transmitted either through internal galleries or by normal small bore connections to the more remote primary or secondary units which are expected to respond to these signals either by way of their associated modular computing valve or more directly.

The siting of a typical modular cartridge assembly in an axial piston rotary barrel pump/motor, its function, and ancilliary modular cartridges are illustrated in the accompanying drawings, in which.

Figure 1:
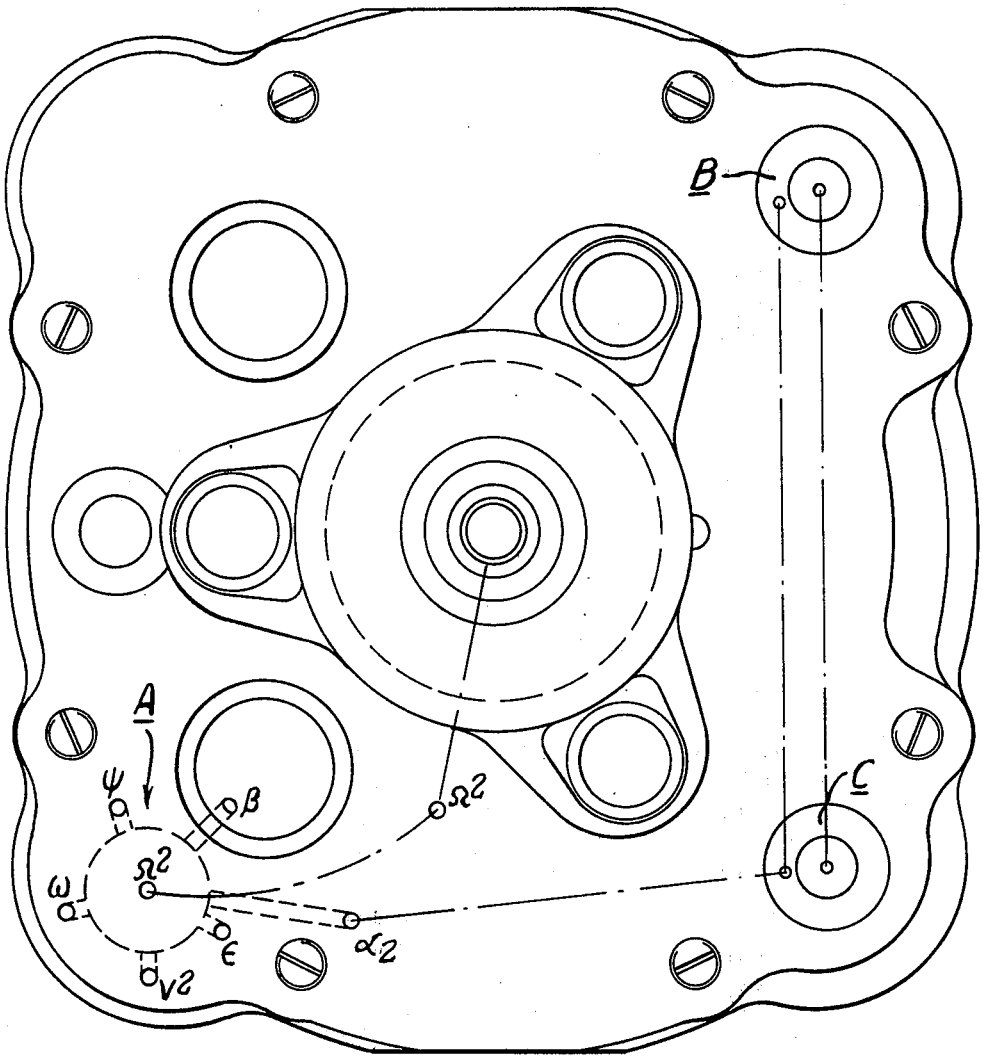
FIG. 1 is a plan view of a pump/motor with its upper casing removed.

In FIG. 1 of the drawings the location of a cored bore for reception of a modular cartridge control valve is shown at A. U.S. Pat No. 3,910,043 teaches a pump in a hydraulic transmission control system which may employ a modular cartridge control valve or control valve assembly as described herein. It will be noted in this regard that FIGS. 5*a*, 5 and 6 of such patent correspond to FIGS. 2, 3 and 4 hereof.

Figure 2:
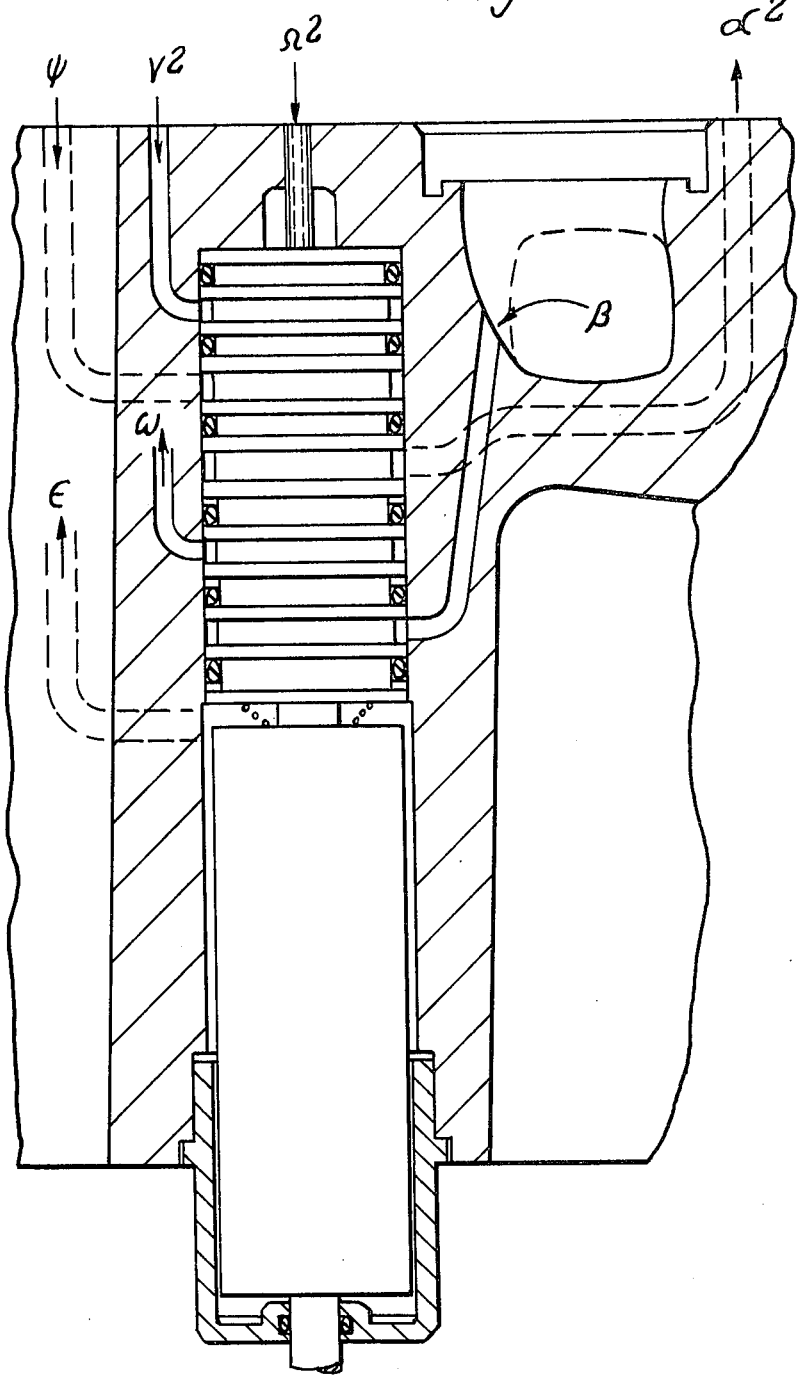
FIG. 2 is a vertical section through a cored bore and a modular cartridge suitable for controlling the unit as a pump formed where shown in the pump/motor body of FIG. 1.

Radial ports are located around the bore, which are referenced $\alpha_2$, $\beta$, $\Psi$, W, $V_2$ and E. The axial spacing of these ports is shown in FIG. 2, which also shows a diagrammatic section of a modular cartridge control valve within the bore.

Figure 3:
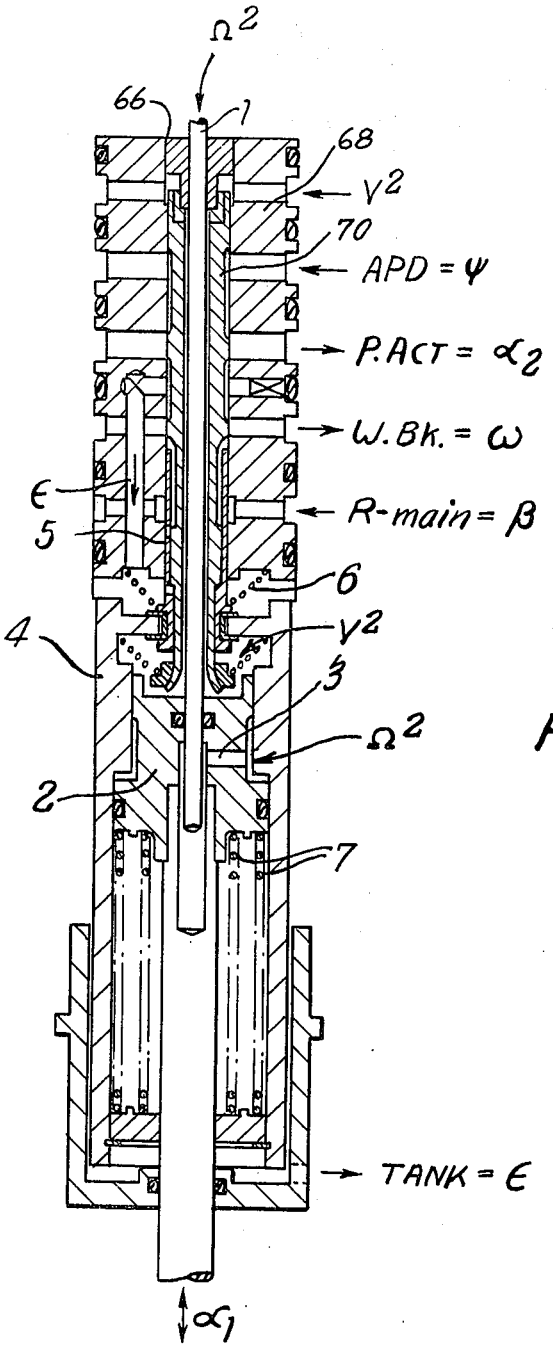
FIG. 3 is a detailed vertical section of the cartridge of FIG. 2.

This cartridge is shown in detail in FIG. 3 and will be seen to include an inlet $\Omega^2$ at its upper end and a mechanical feed back rod $\alpha_1$ at its lower end.

The hole $\alpha_2$ communicates with actuating cylinder(s) B and C (FIG. 1) which serve to control the pump stroke and so vary its displacement. The mechanical feed-back rod appraises the computing value of the stroke or displacement obtaining at any instant of time and serves as the basic base from which differentiation or integration of or with the other input stimuli can determine the direction and extent of control effected through $\alpha_2$.

For example, the pump speed (squared) signal $\Omega^2$ entering axially passes via a small-bore tube 1 axially through the valve spool to an integrating piston or signal processor 2 secured to the feedback rod $\alpha_1$ and via a radial hole 3 in the piston to its differential area; whilst the speed (squared) signal ($V^2$) from the system output drive motor enters the computing valve by the uppermost radial communicating hole as shown and passes axially through the valve spool with but externally of the small-bore tube 1 so as to have effect on the inner area of the integrating piston 2. The cylinder 4 enclosing the integrating piston is attached indirectly to the valve spool 70 by an axially floating sleeve 5 which is biased downwards by conical bias spring 6, whereas helical bias springs 7 between the piston and cylinder counteract the $\Omega^2$ signal minimum basic pressure, which acts on the integrating piston to raise cylinder 4 and floating sleeve 5 as does $V^2$ signal zero based pressure acting on the minor piston diameter, and also differentiates with $V^2$ acting on the remote end of the valve spool 70. Valve spool 70 is disposed within bore 66 of spool valve body 68.

Figure 5:
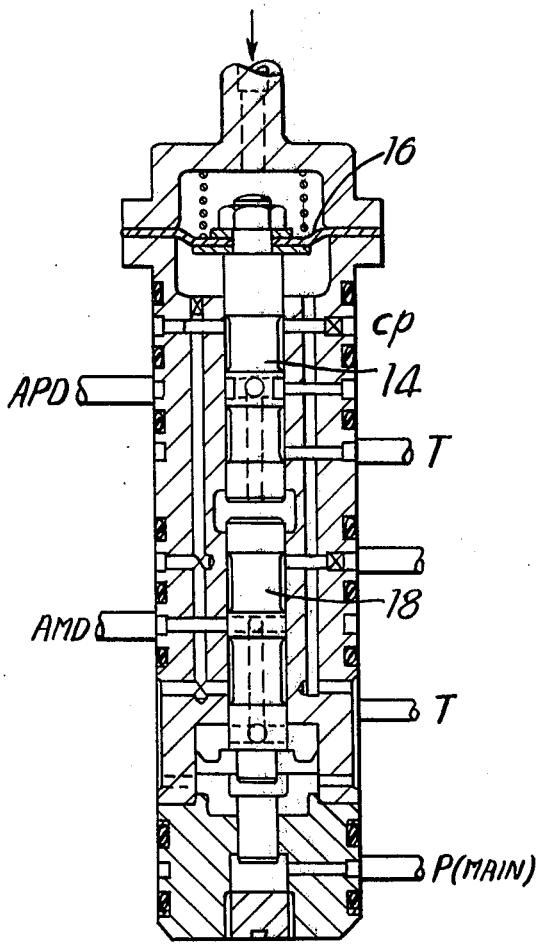
FIG. 5 is a vertical section of an ancilliary modular cartridge used to transmit operator acceleration demand signals.
Figure 6:
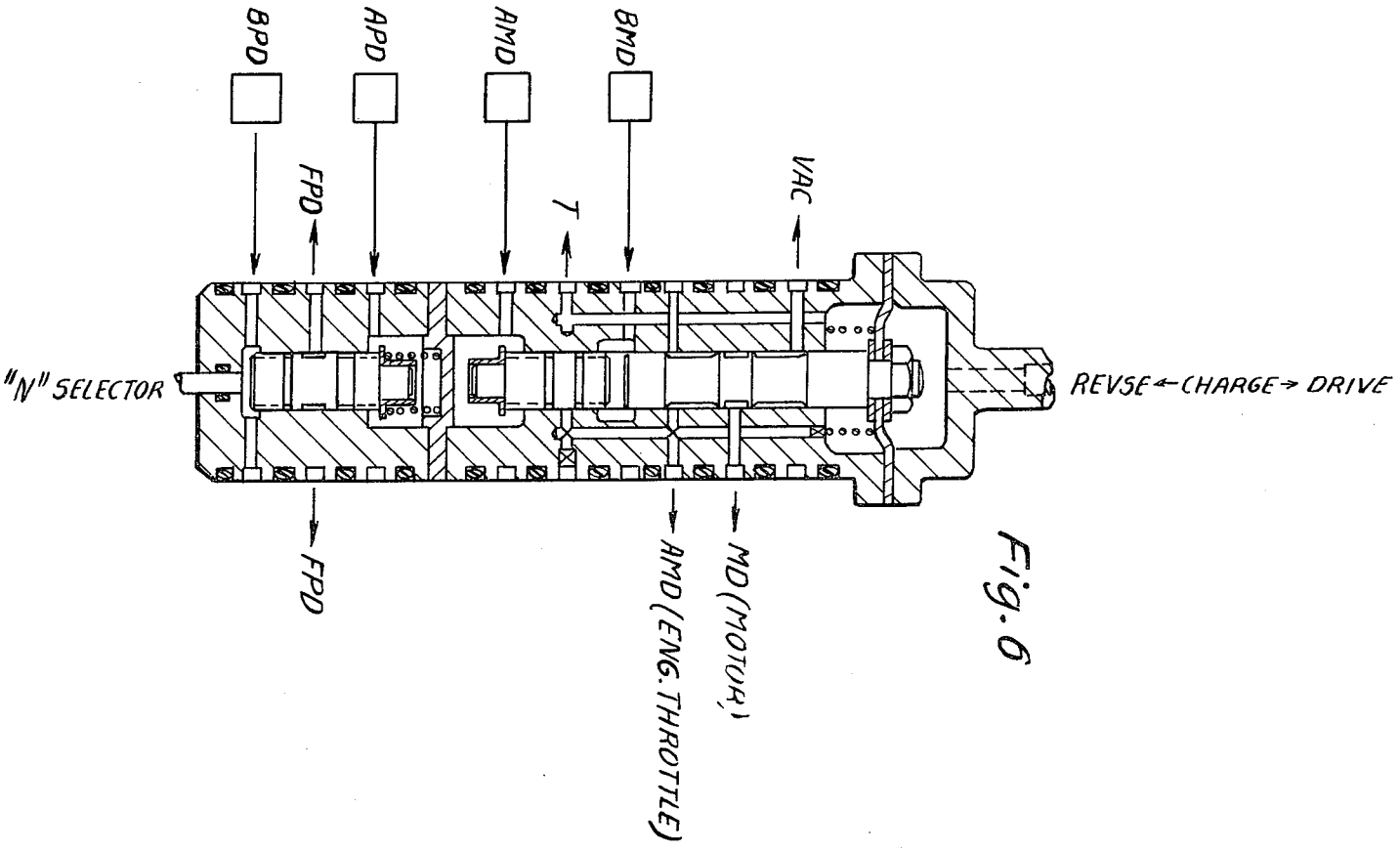
FIG. 6 is a vertical section of an ancilliary modular cartridge used to transmit operator neutral, drive and reverse signals.

The secondmost radial communicating hole introduces the operator's modulated demand signal after processing by a transducer valve shown in FIG. 5 to the same basic-pressure language as the speed-signals ($\Omega^2$ and $V^2$) and the actuating requirement $\alpha_2$ (third radial hole), the value of which, as determined by the processed operator's demand, controls the self-relieving pressure at which the pump will deliver the volume of oil determined by the integrated and differentiated position control of the valve spool.

During over-run of an output drive motor powered by the pump of FIG. 1 and not shown, this motor will act as a pump (as described later) translating vehicle over-run kinetic energy into hydraulic pressure energy which is passed to the accumulator pump which is then required to act as a motor to regenerate kinetic energy for storage. To this end the operator's braking demand signal after processing in a transducer valve, which is substantially identical with the transducer valve of FIG. 5 to control the motor over-run pressure, also serves to generate a signal substantially proportional to the over-run system pressure which signal is passed to the R-main connection (2nd axially) of the computing valve of FIG. 3 of which, subject to integration/differentiation of the $\Omega^2$ and $V^2$ inputs will energise $\alpha_2$ so as to put the pump on stroke until it is just capable of accepting the over-run delivery from the drive motor at the pressure demanded by the operator.

When the energy summation of accumulator and load (integral function $\Omega^2$ and $V^2$) exceeds a predetermined constant occasioned by the helical spring rate, the valve spool moving upward will first dissociate $\alpha_2$ from $\Psi$, then bleed $\alpha_2$ to tank drain $\epsilon$ so that the pump stroke/displacement falls to zero acceptance thereby occasioning the over-running motor automatically to reduce its delivery to substantially zero whilst maintaining the demanded over-run line pressure. Simultaneously, with $\alpha_2$ draining to $\epsilon$ the positioning of the axially floating spool sleeve 5 allows the over-run (returning) line pressure entering at the axially fifth radially inward communicating hole to be spooled to the fourth hole which directs the pressure to an actuator for a frictional load (motor) retarding means. Any corresponding reduction in $V_2$ will cause some movement of the valve spool in the direction of allowing at least partial communication from $\Psi$ to $\alpha_2$, thus allowing sufficient displacement of the pump (acting as a motor) to allow increase of the accumulating kinetic energy, and therefore of $\Omega^2$, inversely to the diminishing velocity, When the pump is working in its normal pumping role, the interaction between the computing valve helical springs and the $\Omega^2$ pressure is such that at maximum $\Omega^2$ pressure the pump stroke-displacement is limited to one-third, increasing to full displacement with decrease of $\Omega$ to one-third of $\Omega$ maximum.

Figure 4:
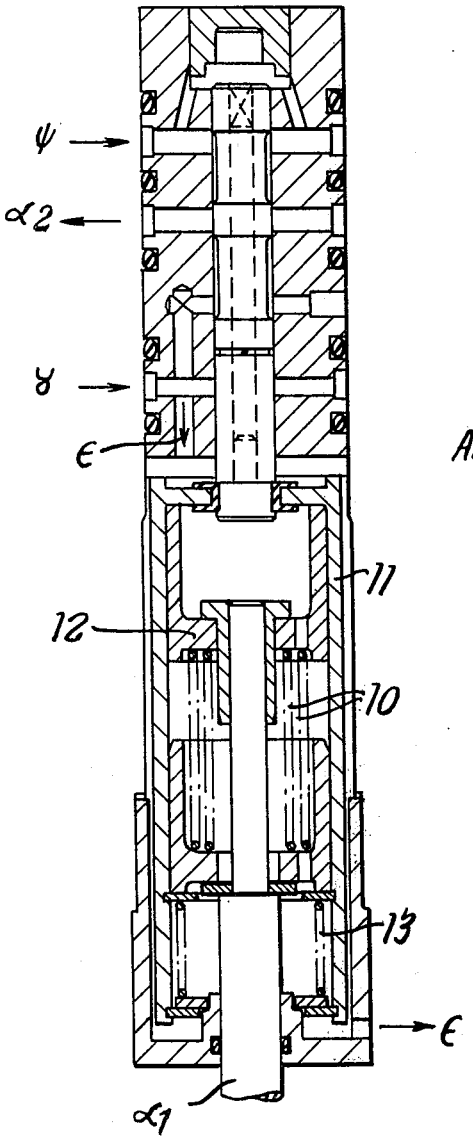
FIG. 4 is a vertical section of a modular cartridge suitable for controlling the pump/motor unit as a motor.

In its simplest form the computer valve shown in FIG. 4, to suit a variable hydrostatic motor (e.g. driving a vehicle) powered by a combustion engine with computing variable pump output, has only one variable input stimulus, that from the operator's demand as processed to a function of pump delivery pressure ($\Psi$). This both provides the actuating pressure $\alpha_2$ when $\Psi$ and $\alpha_2$ are spooled together, and also the upper spool bias pressure working against the analogue springs 10 acting between the cylinder 11 attached to the lower end of the spool, and the piston 12 secured to the stroke feedback rod $\alpha_1$. As a result the motor is only allowed to achieve full stroke-displacement at or approaching maximum demand pressure, thus providing maximum output torque, but at lower line pressure is over-ridded by the lower analogue spring 13 thus spooling $\alpha_2$ to $\epsilon$ and reducing stroke until $\Psi$ and the springs stabilise. However, the springs are "programmed" such that the stroke displacement reduces quicker than the pressure where so required by the pump noise/efficiency pressure characteristic.

Where the motor stroke-displacement is not mechanically stopped from going over-centre, being required so to do to provide a reversed direction of drive, it becomes necessary to introduce a selective hydraulic "neutral" estopment. To this end the axially fourth radial communicating hole to the computing module is piped to the basic control pressure APD (via the interrupting "Reverse" selector shown in FIG. 6) so that the slightest movement of the stroke-displacement towards over-centre from "Neutral" dead-centre will spool through an internal passageway of the spool to (P.ACT ($\alpha_2$) thus obviating further tendency, regardless of line pressures, for the stroke to go over-centre.

The operator's demand signal transducer valves A and B (for acceleration and braking respectively) of the form shown in FIG. 5 are characterised in that the operator's signal, be it haudraulic, pneumatic, mechanical or electro-mechanical acts on one end of a valve spool 14 preferably through the intermediary of an oil-retaining air excluding diaphragm 16 which may additionally be sized to perform the function of a piston of area proportional to the spool end area as the ratio of operator's signal pressure input to processed pressure outlet, i.e. a servo valve powered by a controlled pressure input; the processed output A going to the pump Computing valve of FIG 4 and B to M.C.V.

An extension of this valve has a separate spool 18 also powered by the controlled pressure input, and conveniently in the same module body, and accepts as signal the pressure generated by the pump in response to the operator's signal, and thus pump delivery signal is balanced both by its processed output destined to control the motor stroke and to a lesser extent the processed output from the operator's signal.

I claim:

1. A control valve assembly comprising a multi-input-/output spool valve body, annular collector grooves disposed in predetermined locations externally of said spool valve body, input and output spool ports disposed predetermined positions in said spool valve body, radially disposed drillings in said spool valve body connecting said input and output spool ports with said annular collector grooves, sealing means for sealing adjacent collector grooves from each other, a spool pilot, a signal processor disposed within and movable within said spool pilot, mechanical means mechanically connecting said spool pilot to said spool valve body, said spool valve body having an axial bore therethrough, hydraulic means hydraulically connecting said signal processor to said spool valve via said axial bore, and a tube disposed within said axial bore for transmission of a signal to said signal processor.

2. A control valve assembly according to claim 1, further comprising a mechanical feedback rod and means connecting said rod to said signal processor.

* * * * *

UNITED STATES PATENT OFFICE

CERTIFICATE OF CORRECTION

Patent No. 3,977,437 Dated August 31, 1976

Inventor(s) ROBERT CECIL CLERK

It is certified that error appears in the above-identified patent and that said Letters Patent are hereby corrected as shown below:

Column 3, line 39, after "cylinder" insert: -- or spool pilot --.

Signed and Sealed this

Ninth Day of November 1976

[SEAL]

*Attest:*

RUTH C. MASON
*Attesting Officer*

C. MARSHALL DANN
*Commissioner of Patents and Trademarks*